US008875446B2

(12) United States Patent
Smith

(10) Patent No.: US 8,875,446 B2
(45) Date of Patent: Nov. 4, 2014

(54) SYSTEMS, METHODS AND ARTICLES FOR RESTRAINT

(75) Inventor: James Smith, Atlanta, GA (US)

(73) Assignee: Restraints Solutions, Inc., Atlanta, GA (US)

( * ) Notice: Subject to any disclaimer, the term of this patent is extended or adjusted under 35 U.S.C. 154(b) by 0 days.

(21) Appl. No.: 13/528,806

(22) Filed: Jun. 20, 2012

(65) Prior Publication Data

US 2012/0324804 A1 Dec. 27, 2012

Related U.S. Application Data

(60) Provisional application No. 61/499,111, filed on Jun. 20, 2011.

(51) Int. Cl.
*E04H 3/08* (2006.01)

(52) U.S. Cl.
CPC ..... *E04H 3/08* (2013.01)
USPC ..... 52/106; 52/745.15; 109/1 S

(58) Field of Classification Search
USPC ..... 52/106, 127.1, 169.6, 79.11, 79.9; 109/1 S, 58, 64
See application file for complete search history.

(56) References Cited

U.S. PATENT DOCUMENTS

| | | | | | |
|---|---|---|---|---|---|
| 4,571,901 | A * | 2/1986 | Morris et al. | 52/106 |
| 4,731,964 | A * | 3/1988 | Phillips | 52/106 |
| 4,754,584 | A * | 7/1988 | Newton, II | 52/106 |
| 4,843,788 | A * | 7/1989 | Gavin et al. | 52/205 |
| 4,910,932 | A * | 3/1990 | Honigman | 52/280 |
| 6,151,852 | A * | 11/2000 | Linn et al. | 52/239 |
| 6,412,231 | B1 * | 7/2002 | Palatin | 52/79.1 |
| 6,415,557 | B1 * | 7/2002 | McCalley | 52/79.1 |
| 7,318,300 | B1 * | 1/2008 | Seavy | 52/106 |
| 2003/0066249 | A1 * | 4/2003 | Walsh | 52/79.1 |
| 2004/0103598 | A1 * | 6/2004 | Marler et al. | 52/106 |
| 2008/0256882 | A1 * | 10/2008 | Kidd | 52/235 |
| 2009/0272048 | A1 * | 11/2009 | Amidon, II et al. | 52/106 |
| 2009/0293420 | A1 * | 12/2009 | Smith et al. | 52/783.1 |
| 2010/0064603 | A1 * | 3/2010 | Ciavolella | 52/106 |

* cited by examiner

*Primary Examiner* — William Gilbert
*Assistant Examiner* — Kyle Walraed-Sullivan
(74) *Attorney, Agent, or Firm* — Ballard Spahr LLP

(57) ABSTRACT

The present invention comprises methods and articles for restraint. A plurality of panels may be assembled to form a structure. A method of the present invention comprises providing a structure described herein to confine a subject in a secure area.

15 Claims, 7 Drawing Sheets

SYSTEMS, METHODS AND ARTICLES FOR RESTRAINT

RELATED APPLICATIONS

This application claims the benefit of priority of U.S. Provisional Patent Application No. 61/499,111, filed Jun. 20, 2011, which is incorporated herein in its entirety.

TECHNICAL FIELD

The present invention comprises methods and articles for restraining humans, particularly incarcerated individuals.

BACKGROUND OF THE INVENTION

When prisoners or inmates of city, county, state or federal prisons are removed from the controlled environment where they generally reside, the risk of harm to themselves and to others, and the risk of escape increases. Additionally, people who are uncontrollable, such as those intoxicated by drugs or alcohol, and who need to be contained for treatment, the risk of harming themselves or others needs to be lessened. Currently, approaches used to contain inmates or intoxicated persons involve some sort of shackles on their arms, legs, waists or neck, or rooms dedicated to confining one or more persons.

What many people are unaware of is that inmates must be treated in hospitals or emergency rooms, where the general public also goes for treatment. For example, it is not uncommon for women prisoners to be shackled, hand or leg cuffed, to a bed, during labor and delivery of a child. Pregnant women may wear body restraints within hospitals, and must be accompanied at all times by a guard, who may be armed. For other prisoners attending hospitals, body restraints may be applied unless there is a medical objection. Although shackling may seem more abhorrent in women than it does in men, in both sexes, in some places and countries, it is considered an abuse of human rights. Those responsible for the inmates are concerned about escapes by prisoners and those in hospitals are concerned about medical care for the inmates, and safety of hospital employees and other patients. Faced with patients in chains, doctors and other hospital staff may feel unclear about their responsibilities. Payments for prisoner guards increases the costs to the hospital or prison, and ultimately to all in the community.

Like the rest of the population, there is a growing number of elderly prisoners behind bars. Many state parole boards are considering medical parole for certain inmates who require around-the-clock nursing care to hospitals in hopes of saving the states money and reducing crowding in prisons. The hospitals or nursing homes are not equipped to handle prisoners, whether elderly or not. Medically incapacitated inmates, some comatose, or paraplegic, can cost $750,000 a year. That money pays for guards to watch the inmates treated in hospitals outside the prisons. As the elderly prison population grows, more hospital visits are anticipated.

Another location where prisoners must be kept temporarily is at courthouses. Risk of escape and danger to the public are high, especially for desperate prisoners. Fear of escape leads to inhumane treatment of prisoners when dedicated holding rooms in courthouses are filled. Prisoners have been kept locked in vans, outside of the courthouse, when holding cells are full. If animals were treated in such a manner, it would violate animal cruelty laws.

What is needed are containment systems for inmates who are outside the normal prison grounds, such as at hospitals or courthouses, or at sites where prisoners must be confined temporarily such as in occupied areas or battlefields.

SUMMARY

The present invention comprises systems, methods and articles for containing humans. The articles comprise panels wherein a plurality of panels may be assembled to form a secure area comprising contained space. Such a secure area may be placed in an existing room structure, in a tent, in a courthouse, in a hospital or other structure, or as a free-standing secure area contained space, where it is desired to temporarily contain one or more humans or other animals. For example, a plurality of panels may be joined to form one or more walls. One wall may be used to divide an existing room into two spaces, and provide one or more secure areas or containment spaces. Three or four walls can be assembled to form a triangle or square secure area contained space structure or may be a free-standing contained secure area space. The secure area space may comprise a floor that connects to each and all of the walls along the bottom edge of the walls, and/or may comprise a ceiling that connects to each and all of the walls along the top edge of the walls. A panel may function as a door and/or may have openings or other optional details, such as space for windows, openings for equipment or food trays, and spaces within the doors for ventilation purposes. One or more panels may form a corner by joining two panels, or a corner panel may be molded as one piece. One or more panel doors may operate together to form bi-fold doors or large openings.

Methods of the present invention comprise assembling a plurality of panels to form a confined space, optionally large enough to contain one or more humans comfortably.

Methods of the present invention comprise confining one or more humans within a structure that defines a secure area space, comprising at least one wall comprising a plurality of panels of the present invention.

DETAILED DESCRIPTION

The present invention comprises systems, methods and articles for confining subjects, for example, humans. The present invention comprises panels that can be assembled to form a structure, that, for example, can be placed within an existing room and may be removed easily when no longer needed. The structures are easily assembled, may be shipped, stored or transported intact or in component parts. Methods of the present invention comprise constraining a subject within the structure formed by one or more walls of the present invention. The present invention is useful for confining prisoners in a hospital or emergency room setting, prisoners at a temporary holding site, such as at a courthouse or a battlefield location, or persons who are not in control of themselves who need to be confined for their own safety and the safety of others.

Figure 1A:
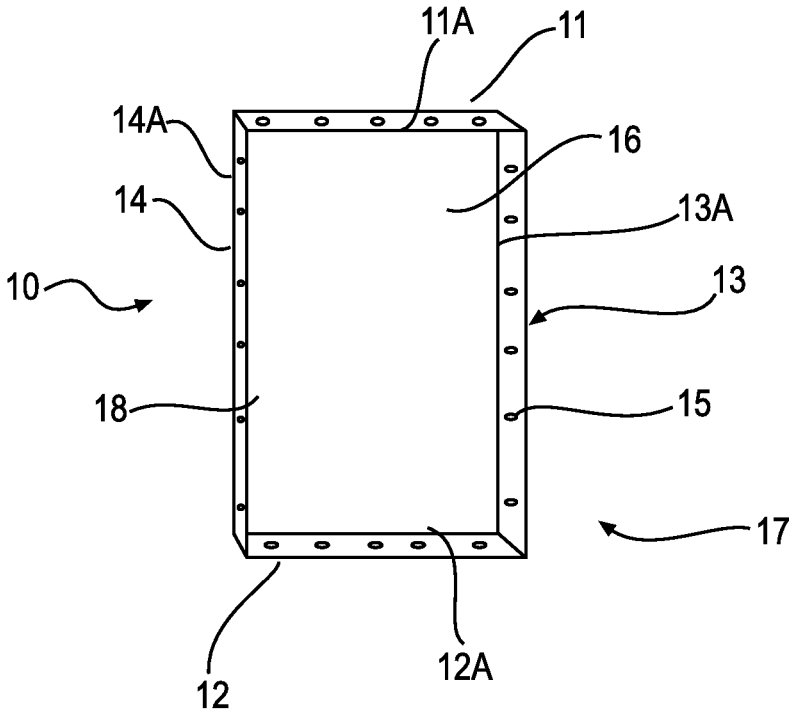
FIGS. 1A-B show an exemplary panel of the present invention.
Figure 1B:
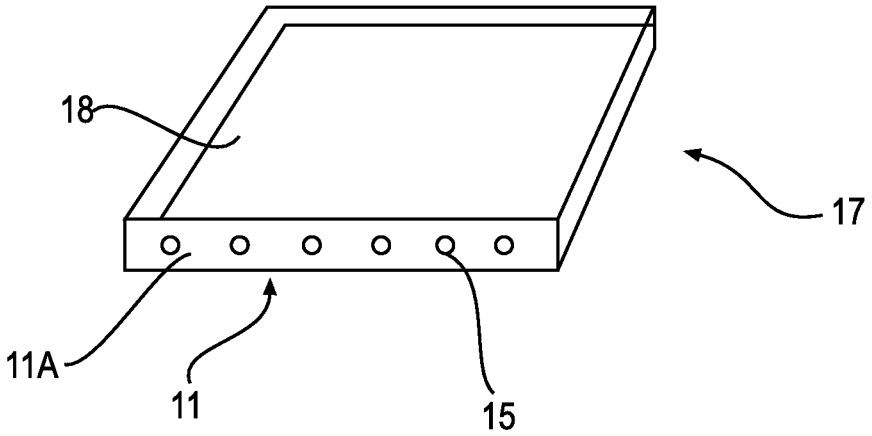

An exemplary article, a panel, of the present invention is shown in the FIG. 1. FIG. 1A shows the exterior side of panel 10 from an overhead position. FIG. 1B shows the exterior surface of panel 10 from a side perspective. The exterior surface of panel 10 is the side opposite the secure area space. In other words, it is the surface of the panel that forms the outer surface of the structure comprised of panels. The interior surface of panel 10 is not shown, but is a generally substantially smooth and flat surface so that when the panels are assembled to form, for example a four-walled structure, the interior walls of the structure are smooth and substantially free of edges that could be accessed by the contained subject(s). In general, a panel is rectangular, though square panels or other shapes are contemplated by the present invention. In a rectangular panel, there are two shorter sides, labeled in FIG. 1A as top side 11 and bottom side 12. There are two longer sides, labeled in FIG. 1A as side 13 and side 14. The body 18 of the panel may be continuous solid material or may have openings 23 through the material of the body from the exterior side to the interior side, including but not limited to, windows, ventilation openings or attachment holes 15. The exterior surface 16 of panel 10 has a flange extending from each side of the panel surface that is formed when the panel is molded. For example, side 11 has a flange 11*a* extending perpendicularly from the flat surface of the panel, as does side 12, having flange 12*a*, side 13, having flange 13*a*, and side 14, having flange 14*a*. A flange may extend in width from about 0.5 to about 4 inches from the surface of the panel, and any range in between, from about 1 inch to about 3 inches, from about 1 inch to 2 inches, from about 2 inches to about 3 inches. The width of the flange is not critical and any width that allows for attachment and adequate support for the panel attachment is contemplated in the present invention.

FIG. 1B shows a side perspective view of side 11, wherein the flange 11*a* extends perpendicularly from the exterior surface 16 of panel 10, and the attachment holes 15 are shown. Attachment holes 15 form an opening through the flange and are generally found in each flange. A flange may comprise one or more attachment holes, or may not have any attachment holes. A panel may comprise attachment holes in places other than a flange. For example, attachment holes may be found in the body of the panel. Such attachment holes in the body of the panel may be used for attaching furniture, such as shelves, molded chair, bed shelves, on the interior of the structure to the panel(s). Attachment holes may also be used for attaching a ceiling panel or floor panel to a panel used as a wall panel in forming a structure.

Attachment holes 15 may be used to attach one panel to another panel. For example, in attaching two panels identical to panel 10, the attachment holes 15 on flange 14*a* of side 14 of a first panel 10 may be aligned with attachment holes 15 of flange 13*a* of side 13 of a second panel 10. Attachment elements such as screws, bolts, welds, nuts, or other components known in the art for joining aligned openings are inserted in the openings and secured in place, such as by tightening a bolt or screw. The two panels are joined in a tight junction so that the flanges on the exterior side are abutted, and the interior surface 17 of the two panels form a substantially smooth surface.

Figure 4A:
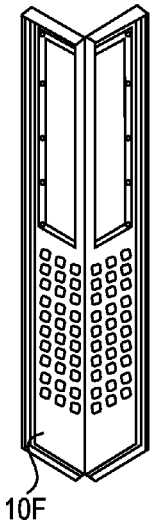
FIGS. 4A-D show exemplary panels of the present invention.
Figure 4B:
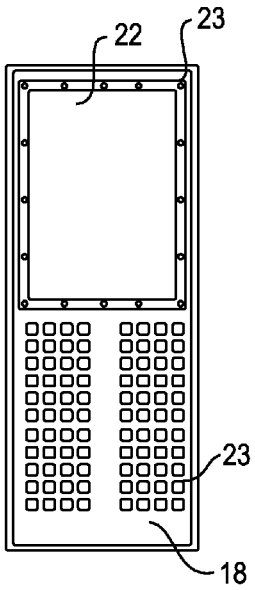
Figure 4C:
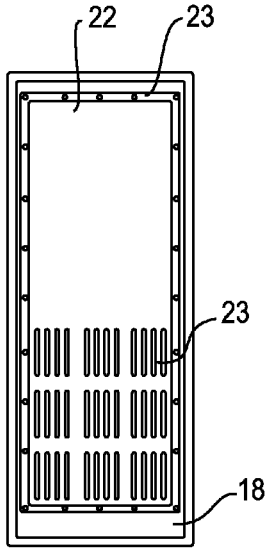
Figure 4D:
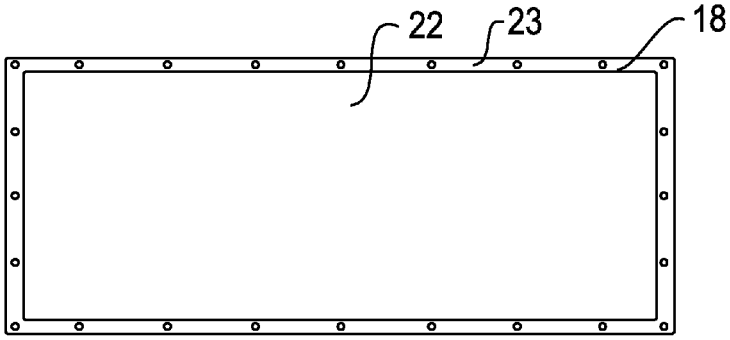

A panel of the present invention may comprise a flat rectangle body having four sides and an interior surface and exterior surface, a flange extending perpendicularly from each of the four sides from the exterior surface, and comprising at least one attachment hole in the flange and/or the body of the panel. A panel may further comprise at least one opening in the body of the panel. A panel may comprise one opening that is substantially the area of the body of the panel and the opening is covered with a welded wire mesh to form a ceiling panel (See FIG. 4D). A panel may comprise one opening that is substantially the area of the upper half of the body of the panel and a clear material is attached so as to cover the opening. (See FIG. 4B) A panel may comprise multiple openings in the body of the panel, or multiple openings in a cover 22 on a panel, to allow the passage of air through the panel from the exterior side of the panel to the interior side of the panel. (See FIG. 4A, B, C).

FIG. 2 shows an assembly 20 of a plurality of panel 10 wherein panel 10 may have differing widths. In 2A, a rectangular opening 23 is cut in panel 10 where a cover 22, made from a material such as plexiglass or Lexan, is bolted, or otherwise attached on the exterior surface 16 of the panel 10 to form a secure window. Panel 10 may have openings 23 that extend through panel 10 from the exterior surface 16 through the interior surface 17 that may provide ventilation for the interior of the structure formed from such a panel and exchange of air between the interior of a structure and the exterior space or environment. FIG. 2B shows panel 10 with widths greater than panel 10 of FIG. 2A, and an opening 23 that is substantially the area of the upper half of body 18. The opening is covered with a material 22. FIG. 2C shows an assembly 20 or wall comprising a door panel 10, labeled 10 *a*. A door may have a handle 27 for locking the door, or may have moveable pins that when extended, secure the door to an adjoining panel 10 or to a floor plate, a track system or continuous threshold, to a floor panel, or to a ceiling panel.

Figure 2A:
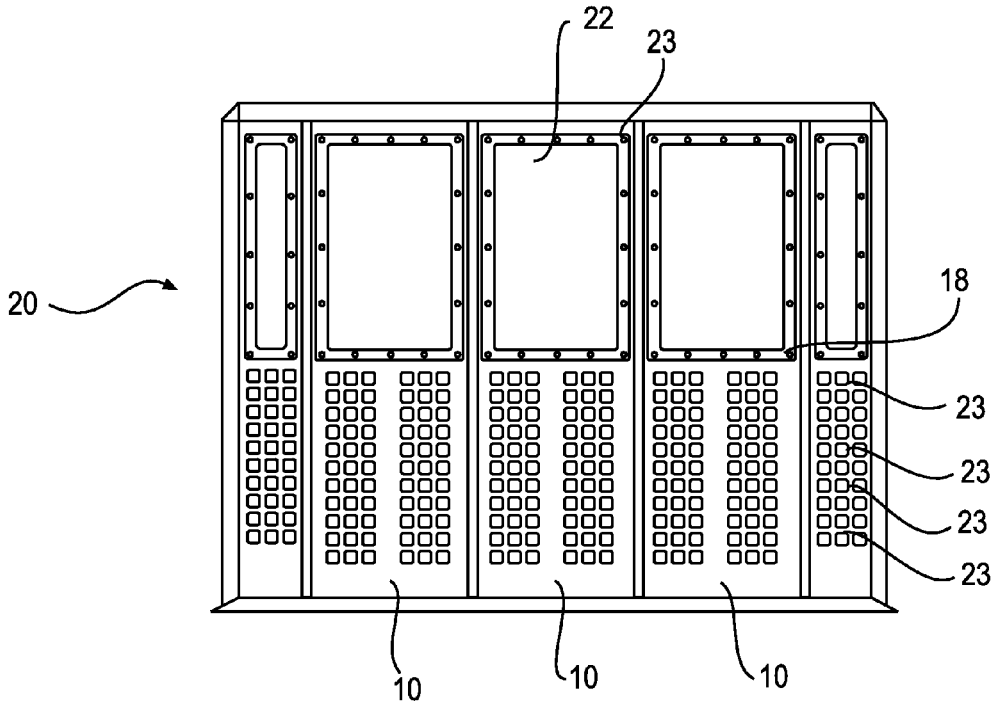
FIGS. 2A-D show exemplary structures made from a plurality of panels of the present invention.
Figure 2B:
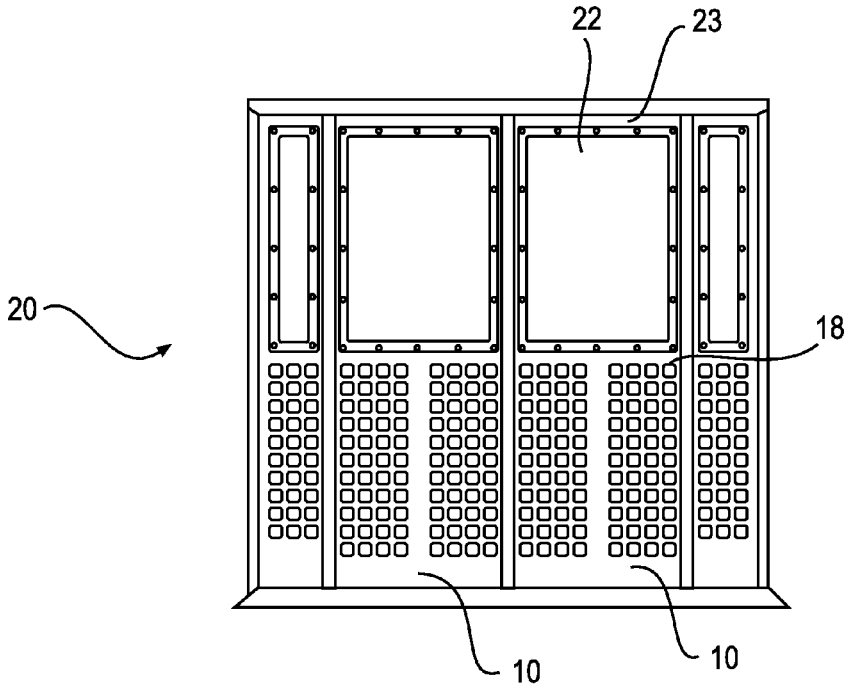
Figure 2C:
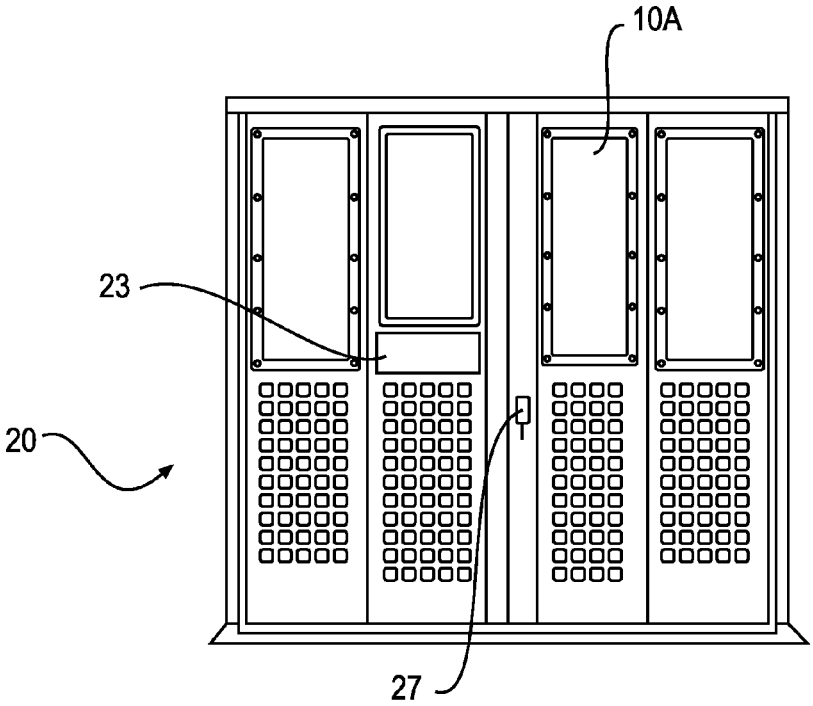

A panel 10 may have openings cut into the panel that extend completely through the panel. Such openings 23 may be covered, by bolting or attaching a separate material, such as plexiglass or lexan or other clear, opaque or solid material over the opening. For example, opening 23 is covered by a transparent cover 22 to form a window. Other openings may be used to access the interior of a structure formed from a panel assembly or system. For example, shown in FIG. 2C is an opening 23 for a subject inside the structure to put its arms out of the structure, for example for application of restraint devices such as handcuffs. For example, a panel 10 may have openings shaped to allow plumbing or air control components within the structure to be accessed by pipes or conduits that pass through the panel from the exterior.

Figure 2D:
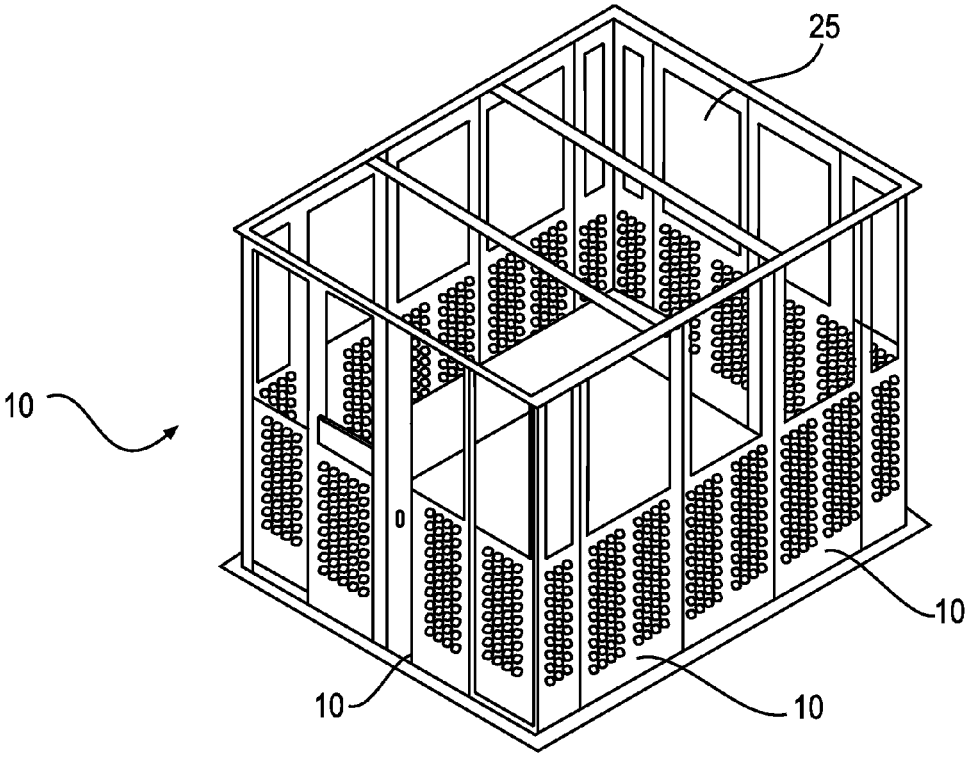

FIG. 2D shows a structure formed by attaching a plurality of panel 10 to form a four walled structure. Optionally, the structure may have a ceiling 25 made from one or more panel 10. As shown in FIG. 2D, the ceiling is made from a panel having an opening 23 that is substantially the area of body 18 except for a rim of the body around the opening and the flanges. The opening may have a cover 22 such as welded wire mesh. Though it is often desired that maximum air flow be maintained, in some embodiments, not shown, the ceiling panels may be solid with no openings, may have one or more openings in a solid panel, or may have one or more openings for air, cooling, heating, reverse pressure control, HVAC access or other access openings for the enclosed structure.

Optionally, a structure formed by a plurality of panels may comprise a floor comprising floor panels. Such floor panels may be solid panels with no openings, or may comprise wire mesh, openings that are filled with slats, or small openings passing therethrough the panel.

Figure 3A:
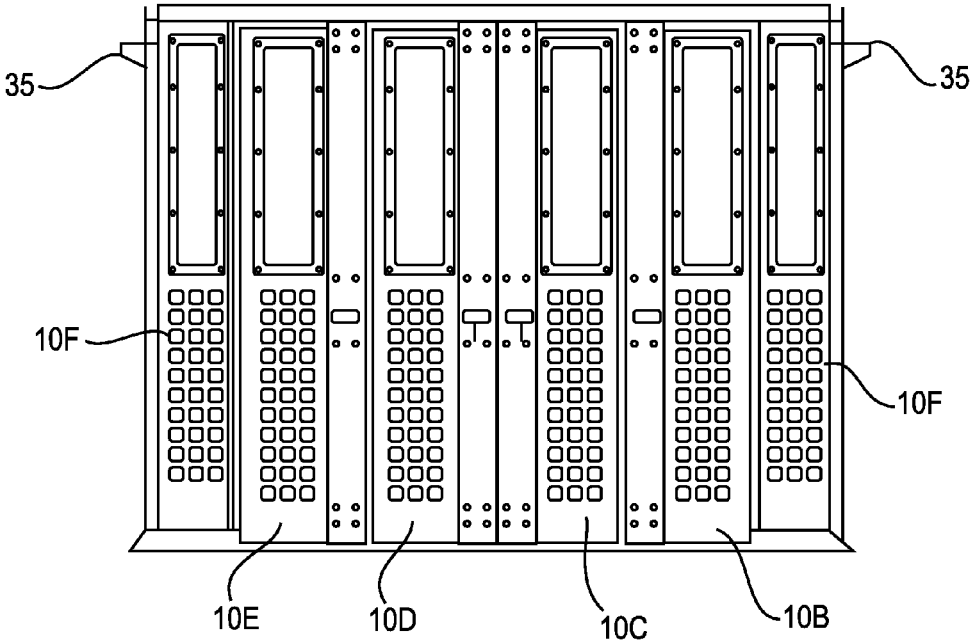
FIGS. 3A-B show exemplary structures made from a plurality of panels of the present invention.
Figure 3B:
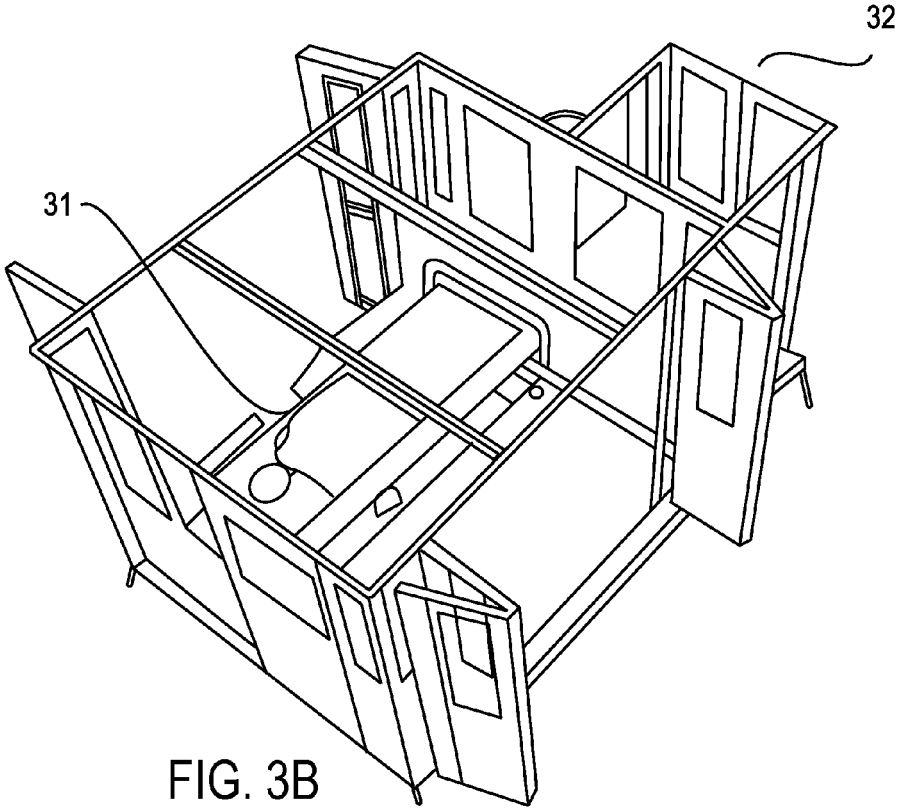

FIG. 3A shows an assembly of panels wherein a bi-fold door is formed from panels 10*b* and 10*c* forming one side and panels 10*d* and 10*e* forming another side of the bi-fold door. One or more panels are hinged, such as by a full length hinge attached to a flange from each panel, for the folding door. FIG. 3B shows an aspect of the present invention where a plurality of panels are assembled to form a contained secure area space that may be used in a hospital setting. Shown is a hospital bed 31 placed within the secure area space and the bed can be accessed from either side of the structure through two bi-fold doors which form two of the walls of the structure. Also shown in FIG. 3B is a lock-out room 32, which may be used for isolating a subject contained within the structure formed from a plurality of panels. Shown on the top of corner panels 10*f* are monitoring devices 35. Monitoring of enclosed subjects may be desired.

FIG. 4 shows examples of panels. FIG. 4A shows a corner panel 10*f* which may be molded as a corner panel from one piece of material, such as metal or plastic. A corner panel 10*f* may be made from attaching two narrow panels 10 and optionally, an angle brace, such as four inch forty gauge steel angle brace, may be used to aid in supporting the attachment of the panels. Flanges may be bent to align attachment holes for forming a corner panel from two smaller panels. FIG. 4B shows a panel 10 having a window opening 23 with a cover 22 of a desired material and which also has ventilation openings 23 in the lower portion of the panel. FIG. 4C shows a panel 10 having an opening comprising substantially the area of body 18, except that a rim around the opening and the flanges of the panel remain. Additionally, a portion of body 18 remains at the bottom of the panel. A cover 22 has openings therethrough. For example, the cover material may be a clear material so that the interior of a structure made from such panels is easily seen at all times. FIG. 4D shows a panel that may serve as a floor or ceiling panel. For example, the panel has an opening that comprises substantially the area of body 18, except for a rim around the opening and the flanges of the panel. The opening 23 may have a cover 22, such as a welded wire mesh cover. Panels of the present invention may be made in any width or height to form desired sized structures. Panels may be custom made to fit particular sites or to form particularly sized walls or structures. Panels used in a structure may be of a uniform size or may be differently sized, depending on the intended use of the structure. An assembly of a plurality of panels may be shaped in any possible shape, including but not limited to one wall, two wall, three wall, four wall, five wall, six wall, seven wall, eight wall, ten wall, twenty wall, thirty wall, and so on, structures. Multiple contained secure areas may be formed from walls formed from the panels disclosed herein, such horizontal rows of cells made from panels. With sufficiently strong panels, structures formed from panels can placed on top of each other to form two story or greater storied structures.

Figure 5A:
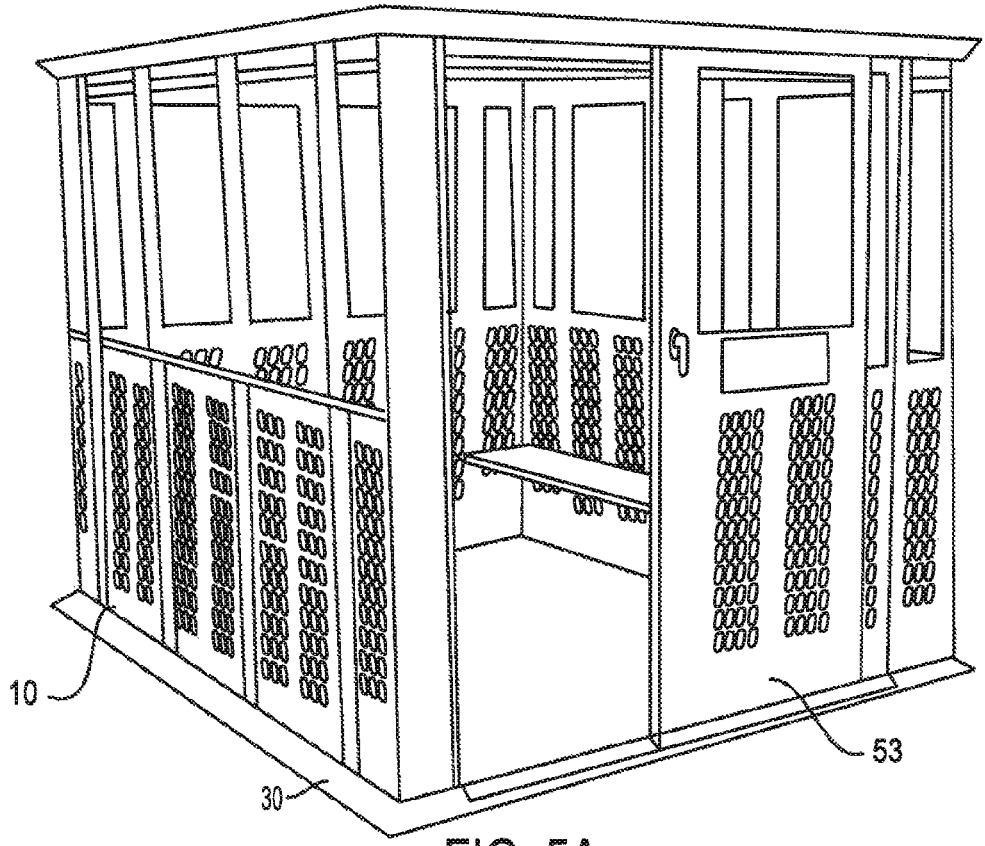
FIGS. 5A-B show exemplary structures made from a plurality of panels of the present invention.
Figure 5B:
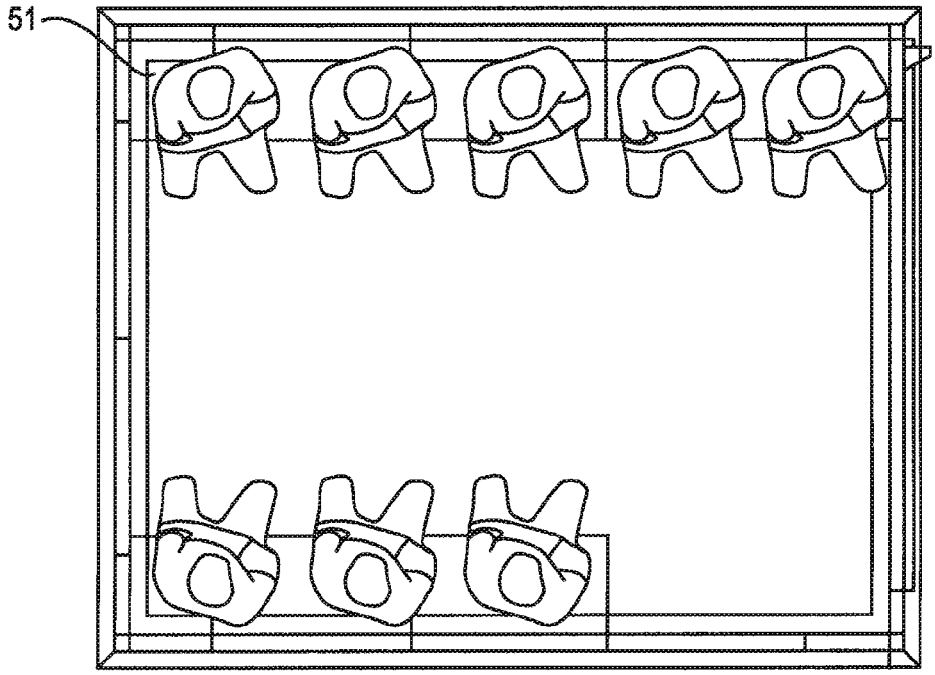

FIG. 5 shows a structure made from a plurality of panels that can contain one or more subjects. FIG. 5A shows an assembled structure from the exterior. For example, a sliding door 53 is shown. FIG. 5B shows an overhead perspective of the interior of the secure area space created by the structure wherein subjects are shown sitting on a bench shelf 51 attached to one or more of the panels.

Figure 6A:
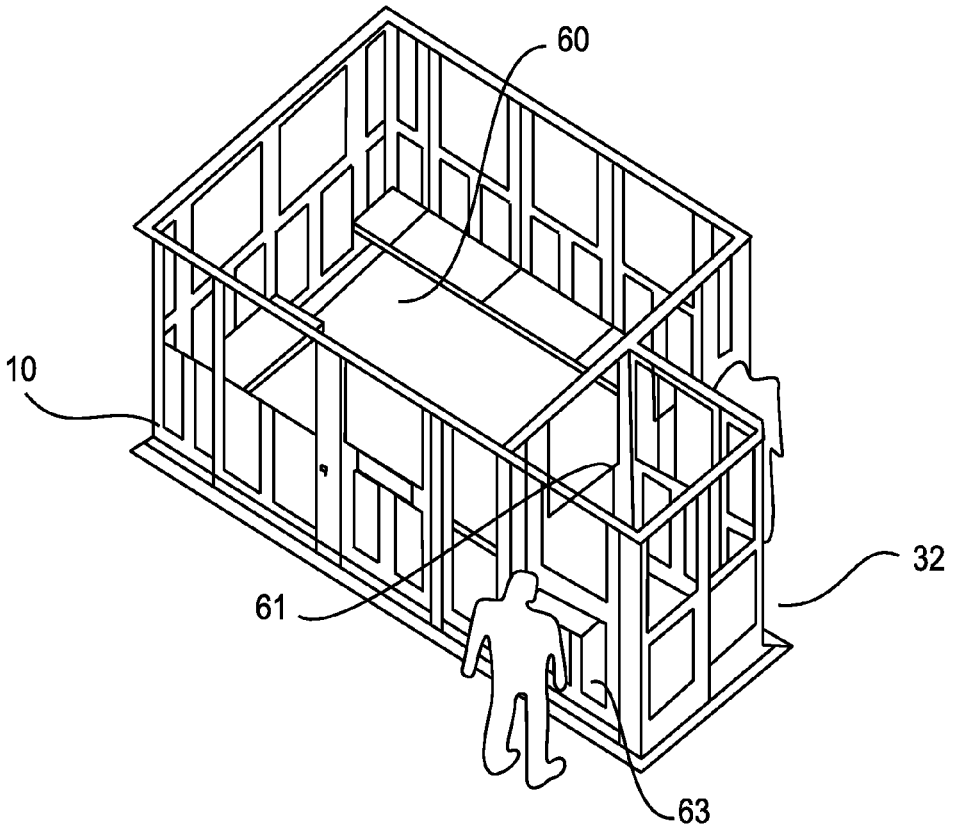
FIGS. 6A-B show exemplary structures made from a plurality of panels of the present invention.
Figure 6B:
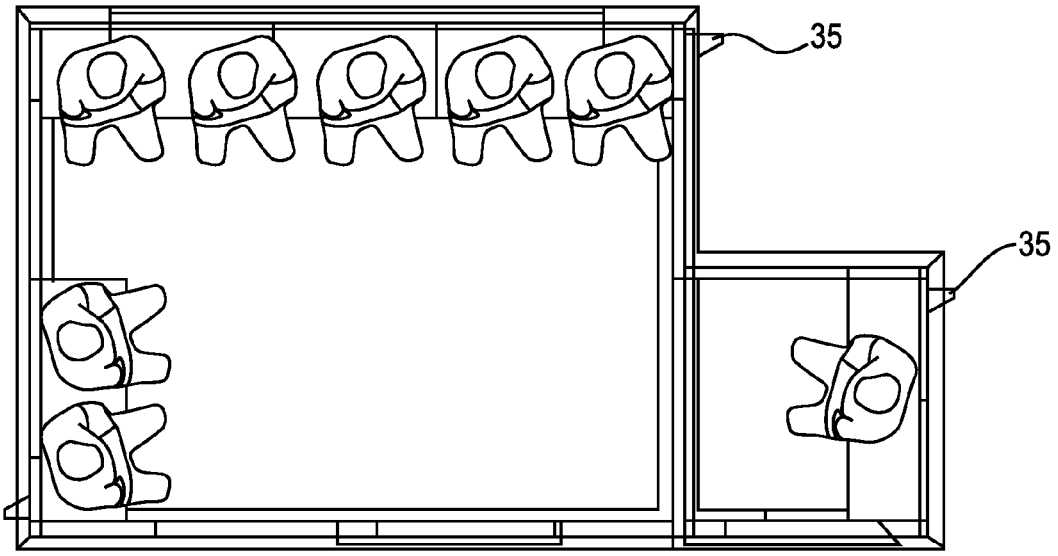

FIG. 6 shows an assembly of a plurality of panels of the present invention to form a structure comprising a lock-out room. FIG. 6A shows a plurality of panels 10 forming a four-walled secure area space structure where on the exterior of one wall, the lock-out room 32 is placed. A door panel 61 is in the wall so that the interior of the larger room 60 is separated from lock-out room 32, but is accessible through the door. The panels forming lock-out room 32 are assembled and attached to at least two panels of the larger room 60. A second door panel 63 may be present as a panel in one wall of lock-out room 32. The second door allows for entry and exit into lock-out room 32 without the need to access door 65 into larger room 60. FIG. 6B shows an overhead perspective of the interior of larger room 60 and lock-out room 32. Monitoring devices 35 are shown.

The panels of the present invention can be used to form structures that are useful in many settings, for example, in a hospital setting, though particular descriptions are not to be limiting to the invention, and one skilled in the art can use the panels and structures formed therefrom in other settings or uses. A walled structure made from a plurality of panels defines a secure area space. A structure, assembly or wall is formed from a plurality of panels. In a hospital setting it may be helpful to have a structure made from panels having two walls with doors, for access from two directions to the larger room by personnel or equipment, such as is shown in FIG. 3B. A structure may comprise only one wall, with or without doors and/or windows, or may comprise multiple walls with or without doors and/or windows.

It is contemplated that the structures formed by the panels of the present invention can be of any size desired, though containment of humans is a desired use of a structure. For a hospital setting, it contemplated that the structure would be large enough to also contain at least a hospital bed. A structure may also comprise seating facilities, such as a built-in chair or a fold-down seat or one or more shelves for sitting, sleeping or placing things on, on the interior or exterior of the structure formed by the walls made from a plurality of panels.

FIG. 3B shows a person in a hospital bed contained within a four wall structure. There are window openings on at least one wall of the larger room and on at least one wall of the smaller attached room, the openings are generally covered with a cover of a material to maintain the security of the enclosed space. The ceiling, not shown, may be optional, or may be formed by one or more ceiling panels comprising cover, made from a material such as a mesh made of a strong material, such as steel mesh. The ceiling panels are attached to each wall of the structure to completely and securely cover the top of the structure. It is contemplated that a person contained in the secure area inside the structure would not be able to puncture the mesh and leave the room.

Not shown in the figure, and which may be optionally present, is a floor made from a plurality of panels. Like the ceiling, panels comprising a suitable floor material may be used to completely and securely cover the bottom of the structure. A person in the room would not be able to puncture the floor material and leave the room, or lift the room and escape under the walls.

One or more panels of a structure, such as a floor panel and/or a panel used in a wall assembly may be attached to the floor, for example by using a bolt through the flange attachment holes along the bottom edge of a wall panel. For example, a concrete or masonry fastener system by Hilti Inc., (Tulsa, Okla.) may be used to attach one or more panels to the floor. Alternatively, one or more panels may be attached to an attachment plate 30, which is securely attached to the floor of the room, by attachment elements such as brackets or clamps, or one or more panels may be attached to a threshold-like plate, track system or continuous threshold that is attached to the floor, that securely attaches one or more panels to the floor so that the structure cannot be moved by someone inside.

As shown in FIG. 3B, two walls have bi-fold door panels as a part of the wall assembly. Also shown are walls where the lower portions of the panels have openings 23. The openings 23 may be of any shape, and may function to allow exchange of air between the interior of the structure and the surrounding environment. The upper portion of a panel in a wall of the structure may comprise on opening 23 with a cover 22 that functions as a drop-down window, or other type of window for accessing the room or the occupant. There may be solid panels without doors, windows or openings, if desired.

The panels are securely attached to each other. In an aspect, the corners of a structure may be formed by two narrow panels joined at an angle, such as a right angle. The corner panels may be made from one piece of material molded to resemble two narrow panels or may be two narrow panels securely attached to each other.

An aspect of the invention comprises panels having flanges on each side extending from the exterior side of a panel, which have one or more openings therethrough the flanges. The panels are attached to each other by abutting the flange of one panel to the flange of a second panel, wherein the flanges comprise attachment holes that align when the flanges are abutted, and using the attachment holes, bolting, screwing or otherwise removably affixing the flange of the first panel to the flange of the second panel. An aspect of the present invention comprises structures made from a plurality of panels that can be assembled and disassembled easily by releasing the attaching elements therethrough the flanges of the panels or other attachment sites, and separating the panels.

Attaching of panels may also be by attaching elements including but not limited to, interlocking edges, by pins, clamps, screws, latches, by tongue and groove interaction of two panels, by welding, or other methods of securely attaching two panels together. If the attaching elements can be removed from the panels, it is preferable that such attaching elements are on the exterior of the structure, so that the confined person cannot reach them. The attaching elements may be used to attach one panel to another, to attach a floor panel to a wall of panels, to attach a ceiling panel to a wall of panels, to attach a panel to the attachment plate bolted or otherwise affixed to the surface such as the floor of a room in which the structure of the present invention is to be provided.

FIG. 6 shows detailed drawings of a lock-box room attached to a larger room, for example, the smaller room 32 attached to the larger room 60 as shown in FIG. 6A. FIG. 6A shows a door 61 for isolating the smaller room from the larger room. As shown, a panel of the lock-box room has a small opening 23 under a window for passing material into or out of, the room, or an opening for hands to be extended, for example, for placing handcuffs or restraints on a person inside. The panel can also function as a door 63.

Monitoring devices 35, such as cameras, are shown attached at the top of some panels, for example see FIG. 6A. Such remote monitoring allows for fewer personnel needed to monitor the contained subject(s). Other types of monitoring may be used with the structures such as audio monitors, motion sensing monitors, or other monitoring systems used to monitor confined subjects. For example, in a prison or hospital situation, one guard could monitor multiple structures or cells containing confined subjects.

A panel of the present invention may be made of any sturdy material that is strong enough to prevent a person from breaking or bending the panels, including, but not limited to, extruded aluminum, steel, ceramic materials, other materials, or combinations thereof. As used herein, to securely fasten two panels together means that a person without tools could not unfasten the two panels, or that a person cannot reach the fastening aspect to unfasten it, such as keeping the handle of a door out of reach of the confined person, such as by placing it on the exterior of the panels and not being accessible from the contained area. A secure area space is means a space that a person placed within the space cannot remove himself or herself from that space. A second person, outside the secure area space, is needed to aid the confined person in leaving the secure area space.

Panels may be used to form three dimensional structures such as are shown herein, or panels may be installed in existing structures to form a separating wall or walls in an interior space to form one or more isolated secure areas within the interior space. For example, in an existing hospital room, a plurality of panels can be assembled to form a wall so that the hospital room is divided into two spaces. An area prescribed by the plurality of panels would be secure and could contain a person and prevent access by the person to the other portion of the room. The wall formed from the plurality of panels may comprise one or more doors or windows, or may have access panels for passing instruments or food trays into the secure portion of the room. The interior of the panels may provide for a fold-down chair or shelf, or may have attachment holes for elements for attaching a chair, shelf or bed to one or more panels. The panels may be attached to the floor as described previously and may be attached to the ceiling of the room in a similar manner.

Methods of the present invention comprise providing a structure to contain at least one subject, such as a structure comprising a plurality of panels, as described herein, and placing a subject within the structure, such as a structure comprising at least one wall, so that the subject is unable to exit the secure area formed by the structure. A method of containing a subject comprises providing a structure to contain at least one subject, wherein the structure comprises a plurality of panels attached so that a secure area is contained by the attached panels, wherein a panel comprises at least a flat surface having at least one flange extending perpendicularly outward from the flat surface, wherein the flange comprises at least one attachment hole for attaching a panel to a second panel; and placing a subject within the structure in the secure area, wherein the subject is unable to exit the secure area formed by the structure. An aspect of a method comprises a structure comprising a panel comprising a door. An aspect of a method comprises a structure comprising a panel comprising a window. An aspect of a method comprises a structure a structure comprising a ceiling panel. An aspect of a method comprises a structure comprising a floor panel. An aspect of a method comprises a structure provided in a courthouse. An aspect of a method comprises a structure provided in a hospital. An aspect of a method comprises a structure provided in an emergency room. An aspect of a method comprises a structure provided in a military site. An aspect of a method comprises a structure comprising a lock-out room. A structure comprising a plurality of panels disclosed herein may be maintained in a negative pressure state so that air only flows into the interior of the structure from the outside environment and any air exiting the structure is filtered or diverted so as to not expose the exiting air to the immediate outside environment so that infectious agents inside the structure are not released to the immediate outside environment of the structure. The structure may maintain negative pressure for HEFE circulation. This status would be helpful in securely containing a subject infected with tuberculosis or other infectious agents. Control of subjects during an infectious outbreak, such as influenza, is also contemplated.

A method comprises providing one wall made from a plurality of panels, optionally, wherein at least one panel comprises a door; attaching the wall to an existing structure such as a room, so as to separate the room into a secure area on one side of the wall, and a non-secure area on the other side of the wall; and placing a person into the secure area of the room. A plurality of walls, each made from a plurality of panels, may be used to divide an existing room or area into multiple secure areas that are separate from one or more non-secure areas. A secure area comprises an area where a person may be contained who cannot free himself or herself from the secure area.

A method of the present invention comprises confining an inmate in a hospital room or an emergency room or any other area of a medical treatment facility, comprising providing a structure comprising a plurality of panels which encloses a secure area, and placing an inmate in the secure area.

A method of the present invention comprises confining an inmate in a hospital room or an emergency room or any other area of a medical treatment facility, comprising providing at least one wall comprising a plurality of panels which encloses a secure area in an existing room of the building, and placing an inmate in the secure area.

A method of the present invention comprises confining an inmate in a secure area of a courthouse or other public facility, comprising providing a structure comprising a plurality of panels which encloses a secure area, and placing an inmate in the secure area.

A method of the present invention comprises confining an inmate in a secure area of a courthouse or other public facility, comprising providing at least one wall comprising a plurality of panels which encloses a secure area in an existing room of the building, and placing an inmate in the secure area.

A method of the present invention comprises confining a person in a secure area, comprising providing a structure comprising a plurality of panels which encloses a secure area, and placing an inmate in the secure area. A secure area may be near a battlefield or near or on a military encampment.

A method of the present invention comprises confining a person in a secure area, comprising providing at least one wall comprising a plurality of panels which encloses a secure area in an existing room of the building, and placing an inmate in the secure area. A secure area may be near a battlefield or near or on a military encampment.

A method of the present invention comprises confining a person in a hospital room or an emergency room or any other area of a medical or psychiatric treatment facility, comprising providing a structure comprising a plurality of panels which encloses a secure area, and placing an inmate in the secure area. A person to be so confined may be under the influence of mental illness, drugs or alcohol.

A method of the present invention comprises confining a person in a hospital room or an emergency room or any other area of a medical or psychiatric treatment facility, comprising providing at least one wall comprising a plurality of panels which encloses a secure area in an existing room of the building, and placing an inmate in the secure area. A person to be so confined may be under the influence of mental illness, drugs or alcohol.

A method of the present invention comprises assembling a structure comprising a plurality of panels to form a secure area. The method comprises attaching a track system or continuous threshold to a surface, such as a concrete floor, asphalt, a road, or a floor in a room in a building. The track system or continuous threshold may be attached using known attachment elements and methods, such as concrete and masonry attachment bolts, screws and nuts. The track system or continuous threshold may be a substantially flat metal plate that attaches to the surface and also provides attachment elements that extend perpendicularly away from the surface. Such attachment elements may be threaded bolts or similar attachment elements onto which the flange on the bottom side of a panel seats. The attachment holes in the flange align with the threaded bolt so that the bolt goes through the attachment hole and is tightly secured so that the flange is abutted and adjacent to the track system or continuous threshold. Securing the flange on the bottom side of the panel to the track system or continuous threshold causes the panel to stand upright so that the top side of the panel is distal from the floor, and substantially parallel to the floor. A second panel may then be attached to at least the first panel by abutting a side flange of the second panel to a side flange of the first panel so that the exterior sides of the first panel and the second panel are facing the same direction. The second panel may or may not be attached to the track system or continuous threshold. Optionally, more panels may be attached, beginning by attaching a panel to the first or second panel or attaching two panels, one to the free unattached side flange of the first panel and one to the free, unattached side flange of the second, and further panels are added by attaching a side flange of a free, unattached panel to the free unattached flange of secured panel. One, some or all of the added panels may or may not be attached to the continuous threshold or track system to anchor a panel to the floor. In an aspect of the present invention, for example, where a four walled structure is formed, a track system or continuous threshold would be present under three of the four walls, and the fourth wall would include at least one panel forming the door into the interior of the structure formed. Optionally, floor panels may be attached to one or more upright, wall panels and/or the continuous threshold or track system by attachment elements secured through attachment holes through the flange of the floor panel or attachment holes in the body of the floor panel that align with attachment holes found in the upright wall panel and/or threaded bolts provided from the continuous threshold or track system. Optionally, ceiling panels may be attached to the standing, upright wall panels. A panel may have attachment holes, displaced from the top edge, where one side of a ledger strip or an L-shaped perimeter bracket or molding, can be attached. The ledger strip or L-shaped perimeter bracket, comprising a piece of metal bent to form a right angle or L shape, comprises attachment holes along one or both edges of the L, is attached so that a ledge extends from the interior side of the panel perpendicularly from the interior side of the panel. The ledge may be of any length, such as from about 0.5 inch to about 4 inches wide, extending away from the interior surface of the panel, and any range in between, from about 1 inch to about 3 inches, from about 1 inch to 2 inches, from about 2 inches to about 3 inches. The width of the ledge is not critical and any width that allows for attachment and adequate support for the ceiling panel attachment is contemplated in the present invention. The ceiling panel is then placed so that the attachment holes of the ceiling panel align with attachment holes on the extending ledge of the ledger strip or L-shaped perimeter bracket and are secured together. Alternatively, if a secure ceiling is not desired, ceiling panels may rest on the ledger strip or L-shaped perimeter bracket and not be secured.

A system of the present invention comprises one or more panels which may be attached so as to form a structure to form an enclosure, at least one panel comprising a door, and other optional units including ceiling panels, floor panels, attachable furniture such as shelves, seats, beds, toilets or sinks, optionally a panel comprising an opening for accessing equipment or the environment outside the enclosure, and attachment elements such as bolts, screws, nuts, concrete or asphalt attachment elements known to those skilled in the art.

An aspect comprises a kit comprising panels and attachment elements, and optionally a track system or continuous threshold, wherein the attachment holes of each panel are aligned, and optionally aligned with the track system or continuous threshold, so that a structure may be easily assembled from the components of the kit to form a secure area, such as for confining and/or containing subjects, including humans.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications may be referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein may be different from the actual publication dates, which can require independent confirmation.

As used in the specification and the appended claims, the singular forms "a," "an" and "the" include plural referents unless the context clearly dictates otherwise. Thus, for example, reference to "a panel," includes a plurality of two or more such panels and the like.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

What is claimed is:

1. A temporary freestanding secure structure comprising:

a plurality of flat panels wherein each panel comprises a flat rectangle body having four sides and an interior surface and an exterior surface and a first flange extending perpendicularly from each of the four sides from the exterior surface, wherein the first flange has a plurality of identically-sized attachment holes, and wherein the plurality of flat panels comprises at least one wall panel and at least one a door panel;

at least four corner panels wherein each panel comprises an "L"-shaped body having four sides and an interior surface and an exterior surface and a second flange extending perpendicularly from each of the four sides from the exterior surface, wherein the second flange has a plurality of identically-sized attachment holes configured to align with the attachment holes of the first flange; and a continuous attachment plate comprising a substantially flat metal plate having an upper surface and attachment elements extending vertically from the upper surface thereof that are sized and configured to mate with the attachment holes provided in the first flange;

wherein each one of the at least four corner panels is selectively joined directly to two flat panels of the plurality of flat panels via the attachment holes provided in the first and second flanges to form a substantially continuous interior wall from the interior surfaces of each of the plurality of flat panels; and wherein each of the plurality of flat panels and each of the at least four corner panels is releasably mounted to the continuous attachment plate to form a temporary secure structure that a subject placed within is unable to exit unaided by a person on the exterior of the secure structure.

2. The temporary freestanding secure structure of claim 1, wherein at least one of the flat panels of the plurality of flat panels further comprises at least one ceiling panel.

3. The temporary freestanding secure structure of claim 1, wherein the plurality of flat panels is selectively movable by a person on the exterior of the secure structure to access a secure area circumscribed by the secure structure.

4. The temporary freestanding secure structure of claim 1, wherein at least a portion of the continuous attachment plate further comprises a track system and wherein at least one door panel is movably secured to the track system to allow selective positioning of the door by a person on the exterior of the secure structure.

5. The temporary freestanding secure structure of claim 4, further comprising at least one floor panel configured to completely and securely cover the bottom of the temporary secure structure.

6. The temporary freestanding secure structure of claim 4, wherein the at least one floor panel is integral with the continuous attachment plate.

7. The temporary freestanding secure structure of claim 2, wherein the plurality of flat panels comprises at least one ceiling panel and wherein the at least one ceiling panel has at least one opening disposed therein.

8. The temporary freestanding secure structure of claim 1, wherein at least one of the plurality of flat panels has at least one opening disposed therein.

9. The temporary freestanding secure structure of claim 8, wherein the at least one opening is at least half of the body of the panel and wherein the at least one opening is securely covered by a clear material.

10. The temporary freestanding secure structure of claim 8, wherein the at least one opening further comprises a plurality of small openings configured to allow for the passage of air through the panel.

11. A method of containing a subject, comprising:

providing a plurality of panels wherein each panel of the plurality of panels comprises a flat body having four sides, an interior surface, an exterior surface, and a flange extending perpendicularly from each of the four sides from the exterior surface and wherein the flange has identically sized and spaced holes disposed therein, wherein the plurality of panels comprises at least one wall panel and at least one door panel;

providing a continuous threshold comprising a substantially flat metal plate having an upper surface and attachment elements extending vertically from the upper surface thereof that are sized and configured to mate with the attachment holes provided in the first flange;

attaching the continuous threshold to a surface;

selectively assembling the plurality of panels and attaching the plurality of panels to the continuous threshold to create a temporary secure structure having a substantially continuous interior wall formed from the interior surfaces of each of the plurality of flat panels; and placing a subject within the temporary secure structure, wherein the subject is unable to exit a secure area formed by the temporary secure structure.

12. The method of claim 11, placing the temporary secure structure in a courthouse.

13. The method of claim 11, placing the temporary secure structure in a hospital.

14. The method of claim 11, placing the temporary secure structure in an emergency room.

15. The method of claim 11, placing the temporary secure structure in a military site.

* * * * *